US005693901A

United States Patent [19]

Matsunaga

[11] Patent Number: 5,693,901

[45] Date of Patent: Dec. 2, 1997

[54] ELECTRONIC MUSICAL INSTRUMENT

[75] Inventor: Kaoru Matsunaga, Shizuoka-ken, Japan

[73] Assignee: Kabushiki Kaisha Kawai Gakki Seisakusho, Japan

[21] Appl. No.: 627,366

[22] Filed: Apr. 4, 1996

[30] Foreign Application Priority Data

Apr. 17, 1995 [JP] Japan ..... 7-114087
Apr. 20, 1995 [JP] Japan ..... 7-117638

[51] Int. Cl.[6] ..... G10H 7/00; G10H 7/10

[52] U.S. Cl. ..... 84/603; 84/622; 84/DIG. 9

[58] Field of Search ..... 84/601–606, 608, 84/622–625, 659–661, DIG. 9

[56] References Cited

U.S. PATENT DOCUMENTS 4,916,996 4/1990 Suzuki et al. ..... 84/603
5,336,844 8/1994 Yamauchi et al. ..... 84/602

*Primary Examiner*—William M. Shoop, Jr.
*Assistant Examiner*—Marlon Fletcher
*Attorney, Agent, or Firm*—Andrus, Sceales, Starke & Sawall

[57] ABSTRACT

According to a first invention, provided is an electronic musical instrument, which decodes and reads waveforms that are compressed by the DPCM method or the ADPCM method, that stores a prediction filter coefficient that is consonant with each waveform and reproduces musical tones by using the prediction filter coefficient. In the first invention, a waveform that is stored in the electronic musical instrument is stored together with a prediction filter coefficient that is used when the waveform was prepared, and the optimal prediction filter coefficient is employed for each waveform to reproduce a waveform.

According to a second invention, provided is an electronic musical instrument, which decodes waveforms that are compressed by the DPCM method or the ADPCM method and repeatedly reads the decoded data, that can repetitiously read waveform data at the loop top without requiring a device for setting a decoding device. In the second embodiment, a waveform that is to be repeatedly read is coded by a prediction filter, for which a prediction filter coefficient is set so that the result of decoding at the repeated reading head portion matches each time.

6 Claims, 9 Drawing Sheets

FILTER COEFFICIENT = 1

| INPUT VALUE | OUTPUT VALUE |
|---|---|
| 1 | 1 |
| 0 | 1 |
| 0 | 1 |

FILTER COEFFICIENT = 2

| INPUT VALUE | OUTPUT VALUE |
|---|---|
| 1 | 1 |
| 0 | 2 |
| 0 | 4 |

FILTER COEFFICIENT = 0. 1

| INPUT VALUE | OUTPUT VALUE |
|---|---|
| 1 | 1 |
| 0 | 0. 1 |
| 0 | 0. 0 1 |

ELECTRONIC MUSICAL INSTRUMENT

BACKGROUND OF THE INVENTION

1. Field of the Invention

A first invention relates to an electronic musical instrument, which reads a waveform that is compressed by a differential PCM method (hereinafter referred to as a DPCM) or an adaptive differential PCM method (hereinafter referred to as an ADPCM) and generates tones, that employs an inherent prediction filter coefficient for each waveform for musical tone reproduction so that it can generate musical tones with a preferable quality and can save waveform memory.

A second invention relates to an electronic musical instrument, which stores a waveform compressed by the DPCM or ADPCM method and repeatedly reads it, that can repeatedly read waveforms without requiring a device for resetting a decoding device at the repeatedly read head portion.

2. Related Arts

It is important for an electronic musical instrument to be able to produce musical tones that are similar to natural tones. Currently, the PCM method has become a primary method by which natural tones, for which sampling has been performed, are stored in waveform memory area, and are read to produce musical tones.

However, the waveforms of natural tones differ in their pitches and in their volumes, and in order to generate musical tones with the PCM method closer to natural tones, waveforms that are different in their pitches and in their volumes must be prepared, and as a result, an enormous amount of waveform memory is required for storing these waveforms.

As memory compression methods, the DPCM and the ADPCM methods are employed, both of which use a prediction filter to store a differential value from a predicted value.

According to the conventional method, however, since a prediction filter coefficient, which is employed for each waveform, is constant, appropriate predicted values can not be obtained for some waveforms, and the quality of the musical tones is so deteriorated that there is an increased demand for improvement.

In the PCM method, not all the data for waveforms, from the initiation of the generation of natural tones until the termination, are stored; instead, a waveform portion at the tone generation start and the following partial waveform are stored. To save on the memory that is required, after a waveform at the tone generation start portion is reproduced, the following partial waveform that is stored is repeatedly reproduced to form a musical tone.

Although, in the DPCM and the ADPCM methods, the repetitious reading of waveforms is considered an effective means, errors are accumulated because data are coded by using a prediction filter.

Further, in order to repetitively read a waveform, the content of a delay register in a prediction filter must match at the repeated head portion each time.

For a conventional electronic instrument, a countermeasure that is taken provides for the resetting of the content of a delay register at the head portion (loop top) that is repeatedly read in order to prevent the cumulative error, and the returning of the waveform at the head portion to its original shape each time. Therefore, a device for applying the countermeasure is provided for a conventional electronic instrument.

As is described above, since a conventional electronic instrument requires a special device for resetting waveform data at the head portion in order to repeatedly read the waveform, the structure of the electronic musical instrument is complicated and the manufacturing costs are increased, with the result that new countermeasures are sought.

SUMMARY OF THE INVENTION

It is one object of a first invention to provide an electronic musical instrument, which stores and reproduces waveforms that are compressed by the DPCM method or the ADPCM method, that stores a prediction filter coefficient that is consonant with each waveform when waveform data are to be prepared, and reproduces musical tones by using the prediction filter coefficient.

In the first invention, a waveform that is stored in the electronic musical instrument is stored together with a prediction filter coefficient that is used when the waveform was prepared, and the optimal prediction filter coefficient is employed for each waveform to reproduce a waveform.

As is shown in FIG. 2, the waveform and the prediction filter coefficient in this invention are set by prediction filter coefficient calculation means 51, for sampling an original waveform and for calculating a prediction filter coefficient; prediction filter coefficient storing means 52, for storing a prediction filter coefficient that is acquired by the prediction filter coefficient calculation means 51; coding means 61, for coding an original waveform in consonance with a prediction filter coefficient, which is acquired by the prediction filter coefficient calculation means 51, and for compressing the coded waveform; and waveform storage means 62, for storing a waveform that was coded by the coding means 61.

A general-purpose computer, for example, stores, for each waveform, in advance, an optimal waveform and a filter coefficient that is used to determine the optimal waveform. These waveform data and the prediction filter coefficient are stored in a memory area of the electronic musical instrument.

An electronic musical instrument that stores waveforms that are compressed by the DPCM method or the ADPCM method, therefore, always employs the optimal filter coefficient that corresponds to a read waveform for tone reproduction, so that tone reproduction at a high compression rate and with a high quality can be performed.

It is one object of a second invention to provide an electronic musical instrument, which stores waveforms that are compressed by the DPCM method or the ADPCM method and decodes the compressed data for repeated reading, that can repetitiously read waveform data at the loop top without requiring a device for setting a decoding device.

In the second embodiment, a waveform that is to be repeatedly read is coded by a prediction filter, for which a prediction filter coefficient is set so that the result of decoding at the repeated reading head portion matches each time.

In this invention, as is shown in FIG. 2, a prediction filter coefficient and a compressed waveform are set in advance by the prediction filter coefficient calculation means 51, for sampling an original waveform and calculating a prediction filter coefficient; the prediction filter coefficient storing means 52, for storing a prediction filter coefficient that is acquired by the prediction filter coefficient calculation means 51; the coding means 61, for coding an original waveform in consonance with a prediction filter coefficient which is acquired by the prediction filter coefficient calculation means 51, and for compressing the coded waveform;

and the waveform storage means 62, for storing a waveform that was coded by the coding means 61.

An electronic musical instrument that employs a waveform according to the present invention comprises a waveform memory area 62, in which waveform data that are acquired by the compression method are stored, and a prediction coefficient memory area 52, in which a prediction filter coefficient is stored. The waveform that is compressed by the DPCM method or the ADPCM method in consonance with the prediction filter coefficient is repeatedly read and the waveform data are decoded.

As is described above, according to the invention, a general-purpose computer, for example, is employed to calculate in advance an optimal waveform and a filter coefficient by simulation, and the acquired waveform data and the prediction filter coefficient that are acquired as the result of simulation are stored in the electronic musical instrument.

An electronic musical instrument, which repeatedly reads a waveform that is compressed by the DPCM method or the ADPCM method, employs a filter coefficient that is quickly convergent and very steady to perform prediction, so that it can absorb an error up until or before the end portion (loop end) for repeatedly reading.

Thus, since the delay register at the repeatedly read head portion (loop top) always contains the same value and therefore a device is not required for resetting a new value when the data reading is shifted from the end portion (loop end) to the head portion (loop top), an electronic musical instrument having a simple structure and excellent compression efficiency can be provided at a low cost.

DETAILED DESCRIPTION OF THE PREFERRED EMBODIMENTS

The preferred embodiments of the present invention will now be described while referring to the accompanying drawings.

First, a first invention will be described wherein, when a waveform is compressed by a general-purpose computer using the DPCM method or the ADPCM method, not only the data for the compressed waveform, but also a prediction filter coefficient that is applied for the preparation of the waveform data and data that correlate the waveform data and the prediction filter coefficient are generated and stored in an electronic musical instrument, and musical tones are reproduced in consonance with these data.

Figure 2:
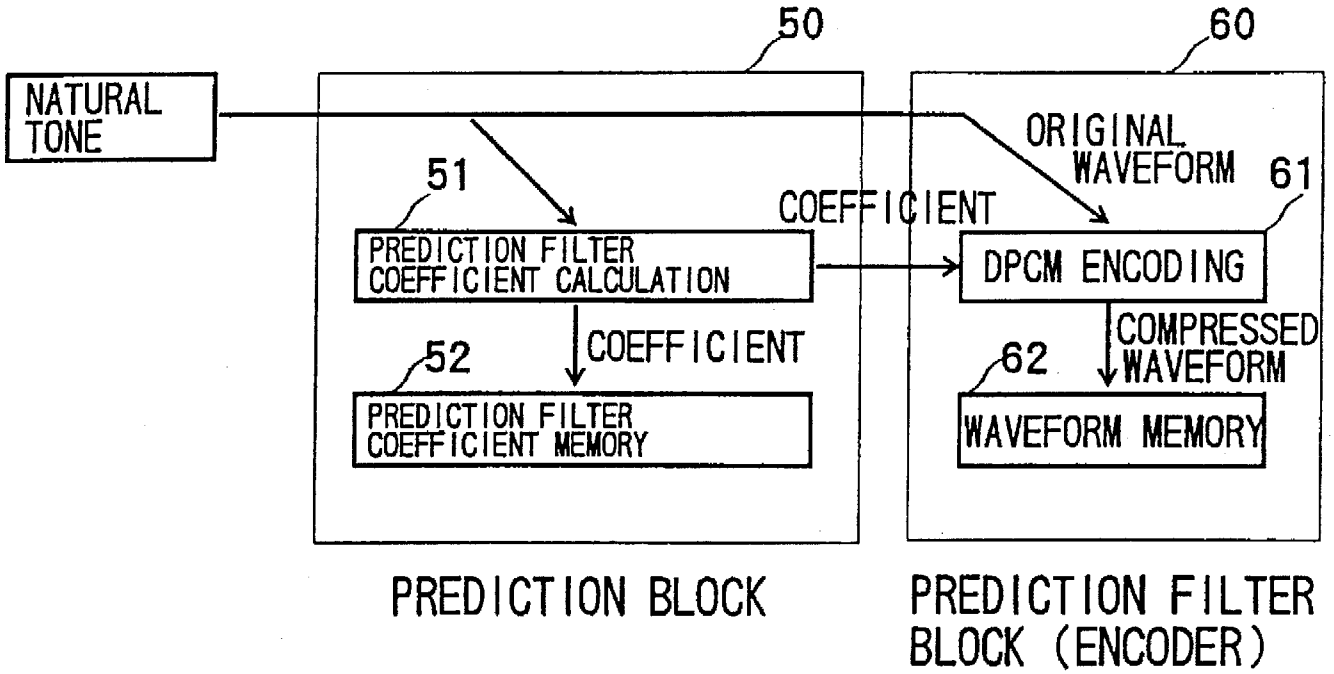
FIG. 2 is a diagram for explaining the processing for calculating a filter coefficient by using a general-purpose computer for waveform compression according to the DPCM method.

FIG. 2 is a diagram for explaining the procedures when a general-purpose computer is used for preparing compressed waveform data and a prediction filter coefficient that are employed in the present invention. The procedures for preparing a prediction filter coefficient and waveform data for a compressed waveform will be explained while referring to FIG. 2.

A prediction block 50 includes a prediction filter coefficient calculation unit 51 and a prediction filter coefficient memory unit 52. A prediction filter block (encoding section) 60 includes a DPCM coding unit 61 and a waveform memory unit 62.

The prediction filter coefficient calculation unit 51 fetches a plurality of samples from an original input waveform, such as those for a natural sound, for predicting a filter coefficient in consonance with the various methods, and calculates and determines the optimal prediction filter coefficient.

A prediction filter coefficient that is determined by the prediction filter coefficient calculation unit 51 is stored in the prediction filter coefficient memory unit 52, and is also transmitted to the DPCM coding unit 61 in the prediction filter block 60.

The prediction filter coefficient memory unit 52, which is, for example, a ROM, in the prediction filter coefficient block 50 is employed to store the prediction filter coefficient that is determined by the prediction filter coefficient calculation unit 51.

The prediction filter coefficient that is stored in the prediction filter coefficient memory unit 52 is used as data that is correlated with each waveform and stored in a prediction filter coefficient memory unit 21 (see FIG. 1) of an electronic musical instrument.

The DPCM coding unit 61 quantizes the original waveform that is input, codes it by the DPCM method in consonance with the prediction filter coefficient, which is transmitted from the prediction filter coefficient calculation unit 51, and compresses the resultant waveform. The compressed waveform is stored in the waveform memory unit 62.

The waveform that is stored in the waveform memory unit 62 is used as data for the waveform memory unit 6 (see FIG. 1) of an electronic musical instrument. The prediction filter coefficient that is stored in the prediction filter coefficient memory unit 52 forms a pair with compressed waveform data that are stored in the waveform memory unit 62. Data for correlating the prediction filter coefficient with the waveform data are also stored in a predetermined area in a ROM (not shown).

Figure 3:
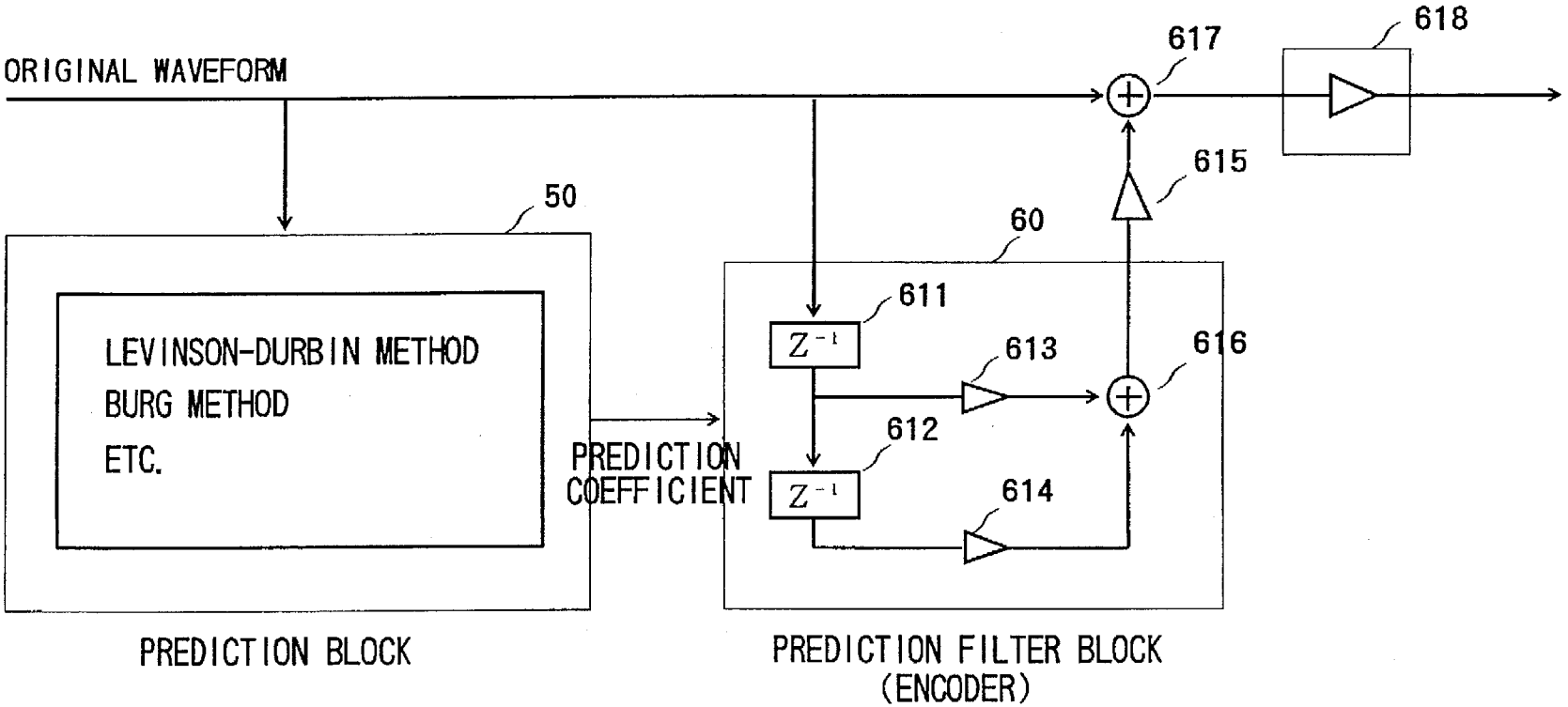
FIG. 3 is a diagram for explaining the processing for coding by using a general-purpose computer.

The processing of the prediction filter block (encoder) 60 when the secondary prediction filter is employed will now be described while referring to FIGS. 2 and 3. For encoding, first, the determination of a prediction filter coefficient in the prediction block 50 is performed.

To decide the prediction filter coefficient, sampling data for the original data is fetched by the prediction filter coefficient calculation unit 51 shown in FIG. 2, which thereafter employs the sampling data to acquire a prediction filter coefficient by means of the Levinson-Durbin method or the Burg method, for example.

The obtained prediction filter coefficient is stored in the prediction filter coefficient memory unit 52 and is also sent to the encoding section 60, which comprises delay registers 611 and 612, multipliers 613, 614 and 615, adders 616 and 617 and a quantization block 618.

With this arrangement, the prediction filter coefficient, which is sent from the prediction filter 50, is set, in K0 (613) and K1 (614), as prediction filter coefficients for primary and secondary filters.

When one part of the original waveform is fetched by the prediction filter block 60, values that were input at the previous time and at the time that immediately preceded it and were fetched to the delay registers 611 and 612 are called, and are multiplied by a predetermined coefficient by multipliers 613 and 614, respectively, and the results are added together by the adder 616.

When the sign is inverted by the multiplier 615, the result is added to the original input waveform by the adder 617 to acquire a difference. Then, the differential value is transmitted to the quantization block 618 and is quantized.

Quantization is a process for compressing the amplitude of the input waveform so that it falls within a predetermined number of bits. Through this process, a waveform having an amplitude for which predetermined compression is performed is output and is stored in the waveform memory 62.

Since the above described procedures are performed to compress a waveform by the DPCM method, during the production of electronic musical instruments, a maker installs in them waveforms that are compressed by the above method, prediction filter coefficients, and data to correlate the waveforms and the prediction filter coefficients, so that electronic musical instruments with compressed waveform memories and with good tone quality can be provided.

As for the relationship between the method of the present invention, which provides for the storage of a prediction filter coefficient for each waveform, and memory quantity, when we consider the fact that data consisting of several tens of thousands of points are required to store one-second waveform data for a single waveform, while only one or two sets of data are required for the prediction coefficient for each waveform, it is clear that the increase in the amount of memory is small, and that no drastic increase in memory is required.

Figure 1:
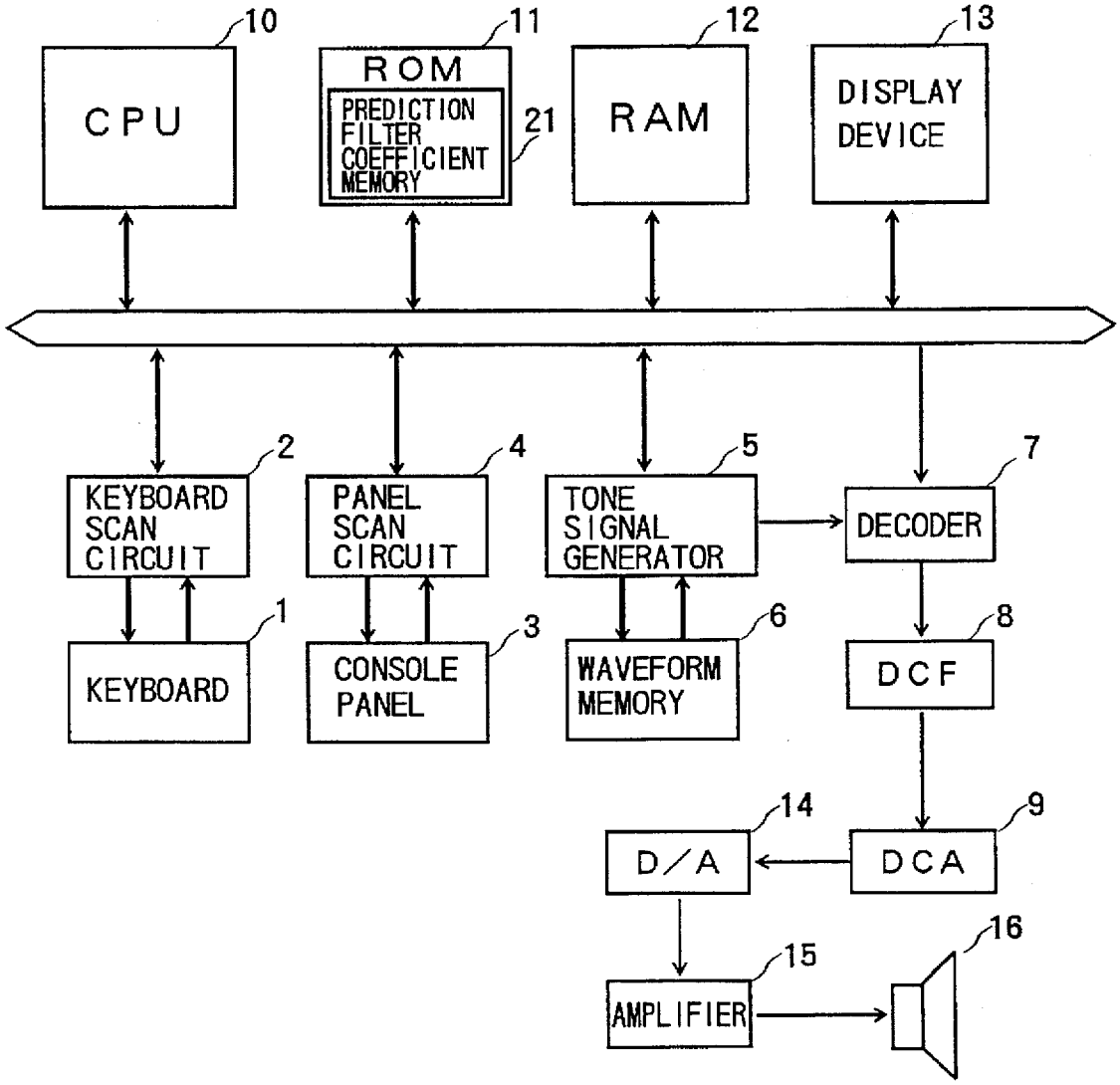
FIG. 1 is a block diagram illustrating the general structure of an electronic musical instrument that mounts waveform data according to the present invention.

An electronic musical instrument that employs a waveform and a prediction filter coefficient that are produced according to this embodiment will now be described while referring to the drawings. FIG. 1 is a schematic block diagram for explaining the general arrangement of an electronic musical instrument according to the present invention.

Reference number 10 denotes a CPU; 11, a ROM; 12, a RAM; and 13, a display device. Reference number 1 denotes a keyboard; 2, a keyboard scan circuit; 3, a console panel; 4, a panel scan circuit; 5, a tone signal generator; and 6, a waveform memory.

Reference number 7 denotes a decoder; 8, a digital control filter (hereinafter referred to as a DCF); 9, a digital control amplifier (hereinafter referred to as a DCA); 14, a digital analog converter (hereinafter referred to as a D/A converter); 15, an amplifier; and 16, a loudspeaker.

The CPU 10 controls the individual sections of the electronic musical instrument in consonance with a control program that is stored in a program memory area (not shown) of the ROM 11, and reads predetermined data that correspond to keys that are depressed on the keyboard 1 to generate musical tones.

In the ROM 11 are stored not only the above program for operating the CPU 10, but also timbre data and various other fixed data. A filter coefficient that is directly related to the present invention is stored in the prediction filter coefficient memory unit 21 of the ROM 11.

In the RAM 12 are defined a work area for the CPU 10, and a register, a counter, a flag and a buffer for controlling the electronic musical instrument. Also, the RAM has a data area to which necessary data, selected from among the data that are stored in the ROM 11, are transferred for temporarily storage.

In addition, in the RAM 12 are provided a plurality of registers in which data that are required for tone generation are held in consonance with the setup state of the keys and switches on the console panel 3; assigner memory in which are stored data for assigning tone generation circuits (DCO) of the tone signal generator 5 to unused channels; and a storage area in which tone information is stored.

The keyboard 1, which is used to designate a musical tone to be produced, includes a plurality of keys and key switches that are opened and closed, interacting with key depression and key release. Key depression and key release by a player are detected by the keyboard scan circuit 2, and the detected signals are transmitted to the tone signal generator 5 under the control of the CPU 10.

Play data that are generated by the depression or release of a key on the keyboard 1 are temporarily held in a predetermined area of the RAM 12, and are read by the CPU 10 as needed.

The keyboard scan circuit 2 detects key depression or key release by a player, i.e., the ON/OFF state of a key, and transmits the detected ON/OFF information for a key, together with its key number, to the tone signal generator 5. The CPU 10 stores the received key ON/OFF information in the RAM 12.

For the console panel 3 are provided a power switch, a timbre select switch, a mode select switch, a melody select switch, a rhythm select switch and various other switches, and a display section.

The set/reset state of each switch on the console panel 3 is detected by the internally provided panel scan circuit 4. Data that are detected by the panel scan circuit 4 that concern the set states of the switches are stored in a predetermined area in the RAM 12 under the control of the CPU 10.

Besides the various switches, a display device 13 for displaying information is also provided on the console panel 3.

The tone signal generator 5 reads, from the waveform memory 6, tone waveform data and envelope data that correspond to a signal that is output by the CPU 10, and adds the read tone waveform data to the envelope data to form a tone signal, which is then output.

The tone signal generator 5 is constituted by digital control oscillators (hereinafter referred to as DCOs) whose count is equivalent to the number of simultaneously produced musical tones. A tone signal for each musical tone is generated by a different DCO, and is transmitted to the decoder 7.

It should be noted that the waveform memory 6, wherein waveform data and envelope data are stored, is connected to the tone signal generator 5.

The decoder 7 decodes waveform data that are transmitted by the tone signal generator 5. The prediction filter coefficient of the present invention is employed when the decoder 7 decodes waveform data.

The digital control filter (DCF) 8 adds a timbre change to a tone waveform that is received from the decoder 7. The digital control amplifier (DCA) 9 adds amplitude modulation to the tone waveform that is received from the DCF 8.

The amplifier 15 amplifies by a predetermined gain an analog tone signal that is transmitted by the D/A converter 14. The output of the amplifier 15 is sent to the loudspeaker 16.

The loudspeaker 16 converts an analog tone signal, which is received as an electric signal from the amplifier 15, into an acoustic signal. In other words, a musical tone that is consonant with the produced tone signal is released through the loudspeaker 16.

With the above described arrangement, when playing starts, key depression/key release data, which are input at the keyboard 1 that is connected via the keyboard scan circuit 2, and tone generation condition, which has been set by the console panel 3 that communicates with the panel scan circuit 4, are temporarily stored in the RAM 12.

Then, in consonance with a predetermined timing, keyboard data and panel event data that are stored in the RAM 12 are read by the CPU 10 and computation is performed for these data. The obtained result is thereafter transmitted to the tone signal generator 5. A compressed tone signal is then read and sent to the decoder 7, which decodes the received tone signal to generate the original waveform.

Figure 4:
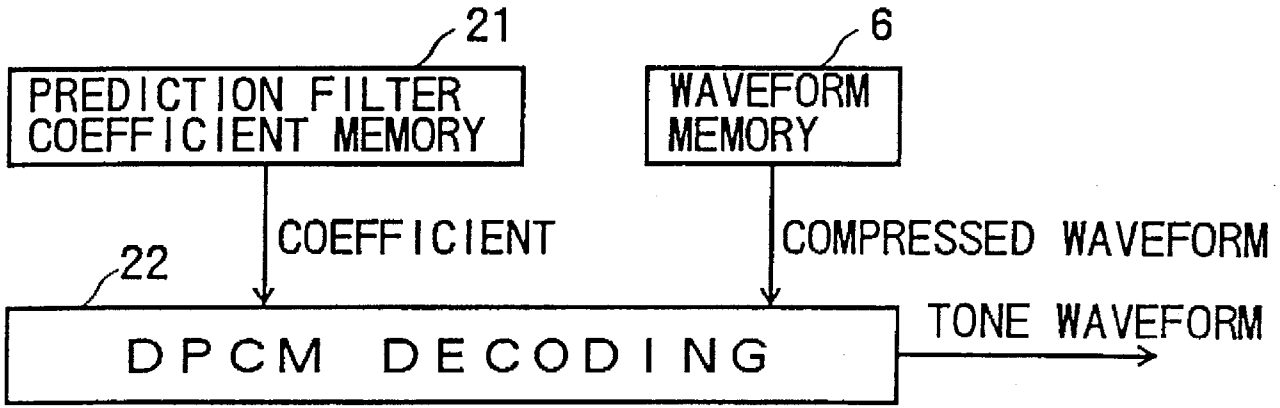
FIG. 4 is a diagram for explaining the structure of a decoder of an electronic instrument that processes waveform data obtained by the DPCM method.

The decoding processing performed by the decoder 7 (see FIG. 1) of the present invention, which is employed for an electronic musical instrument, will now be explained while referring to FIG. 4.

The sections that are directly related to the decoding performed by the present invention are the waveform memory 6, wherein compressed waveform is stored; the prediction filter coefficient memory unit 21, wherein a prediction filter coefficient is stored that is read when the compressed waveform is to be decoded; the DPCM decoding section 22, for performing the DPCM decoding; and a correlated data storage unit (not shown), wherein data is stored that correlates the waveform data that is read from the waveform memory 6 and a prediction filter coefficient.

With the above arrangement, when key depression at the keyboard 1 is detected, for example, the tone signal generator 5 reads the corresponding waveform data from the waveform memory 6, and generates and outputs a tone signal to the decoder 7.

The CPU 10 receives the correlated data for determining a prediction filter coefficient that corresponds to a waveform that is read by the tone signal generator 5. In response to this, the CPU 10 reads a predetermined prediction filter coefficient from the prediction filter coefficient memory unit 21 and transmits it to the DPCM decoding section 22.

The DPCM decoding section 22 decodes the data in consonance with the received prediction filter coefficient and produces a tone waveform. The decoding processing will be described in detail while referring to FIG. 5.

Figure 5:
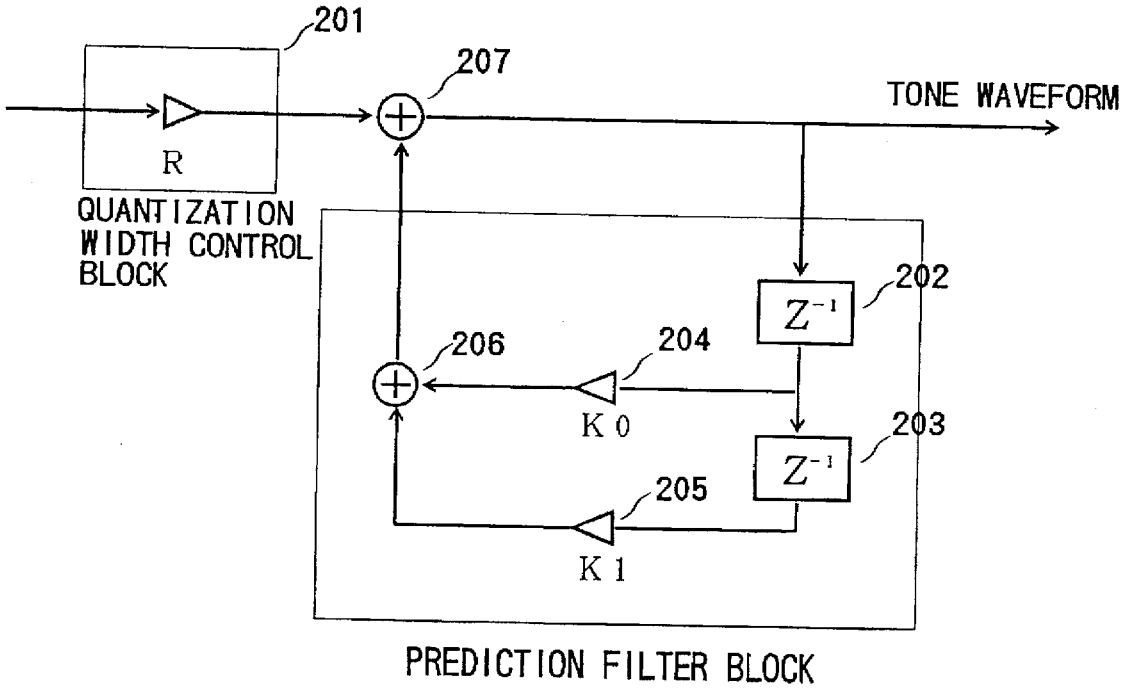
FIG. 5 is a block diagram for explaining the structure of a decoder of an electronic instrument that processes waveform data obtained by the DPCM method.

FIG. 5 is a diagram for explaining the configuration of the decoder 7 that is included in the electronic musical instrument of the present invention. As is shown in FIG. 5, the decoder 7 comprises a quantization width control bock 201, delay registers 202 and 203, multipliers 204 and 205, and adders 206 and 207.

With such an arrangement, when a compressed waveform that is read from the waveform memory 6 by the tone signal generator 5 is transmitted to the decoder 7, the quantization width control block 201 of the decoder 7 controls and outputs the quantization width.

At the same time, the CPU 10 reads, from the prediction filter coefficient memory unit 21, a prediction filter coefficient that is correlated with the tone waveform that has been read by the tone signal generator 5, and sets the prediction filter coefficient as a coefficient for each multiplier of the decoder 7 in K0 (204) and K1 (205).

Then, the data that are already stored in the delay registers 202 and 203 are read, and a predetermined calculation is performed for the data by the multipliers 204 and 205. The obtained results are sent to the adder 206 where they are added together to acquire a desired prediction value.

The prediction value is sent to the adder 207 and added to the input data, and the original tone waveform is produced and sent to the DCF 8.

It should be noted that the above process is repeated each time waveform data is transmitted from the tone signal generator 5. One part of the waveform, which is obtained by addition at the adder 207 and is output, is fetched by the delay registers 202 and 203, sequentially, and is stored in the delay registers 202 and 203 as the previous waveform data and the waveform data that immediately preceded it.

According to the present invention, since a waveform is constantly coded or decoded by using an optimal prediction filter coefficient that is consonant with the waveform, a musical tone having a high quality can be obtained with only a slight increase in memory.

Although the secondary encoder and decoder are employed for this invention, the present invention is not limited to them. Further, although the prediction filter coefficient memory is provided in the ROM, the memory may be provided, for example, either in the tone signal generator 5 or in other sections.

The employment of the present invention for a waveform that is to be compressed by the ADPCM method will now be described.

The ADPCM method is the DPCM method that uses adaptive quantization. Since by this method a quantization width is adapted that is in consonance with an amplitude value, the ADPCM method is used as a highly efficient coding system that can perform high level coding, when compared with the DPCM method.

The actual structure and the processing performed by an apparatus when the ADPCM method is applied to the present invention are substantially the same as those when the DPCM is applied, the only differences being those in the signal coding and decoding sections. Thus, no explanation will be given for the sections that perform the same processing, and only those sections that are different will be explained.

Figure 6:
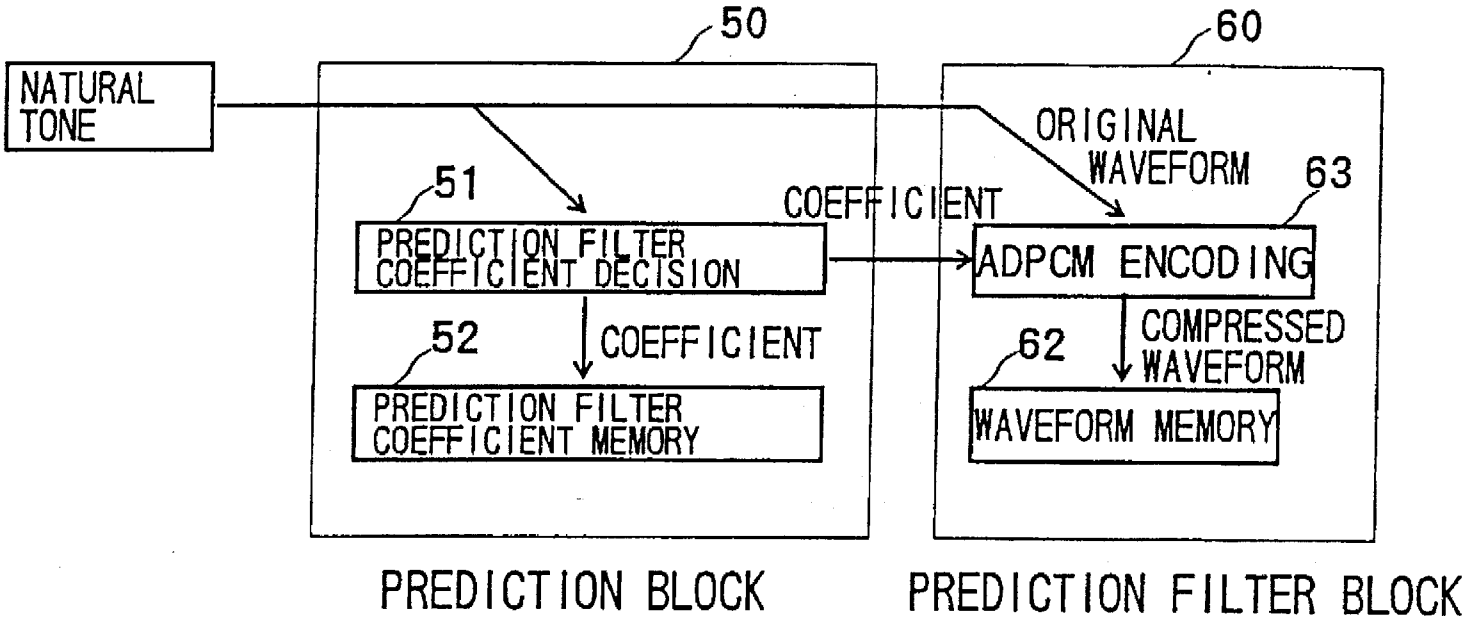
FIG. 6 is a diagram for explaining the processing for calculating a filter coefficient by using a general-purpose computer for waveform compression according to the ADPCM method.

FIG. 6 is a diagram for explaining the procedures for compressing a waveform when the ADPCM method is employed for the generation of a waveform. As is shown, when a filter coefficient is to be determined, the only difference from the DPCM method is that an ADPCM coding unit 63 takes the place of the DPCM coding unit 61 in the prediction filter block 60. The ADPCM coding method is a known technique.

Therefore, in the same manner as by the DPCM method, an arbitrary filter coefficient is set and a waveform is coded by the ADPCM coding method. Then, the coded waveform is reproduced and examined. The above process is repeated to select a preferable prediction filter coefficient by trial and error.

Figure 7:
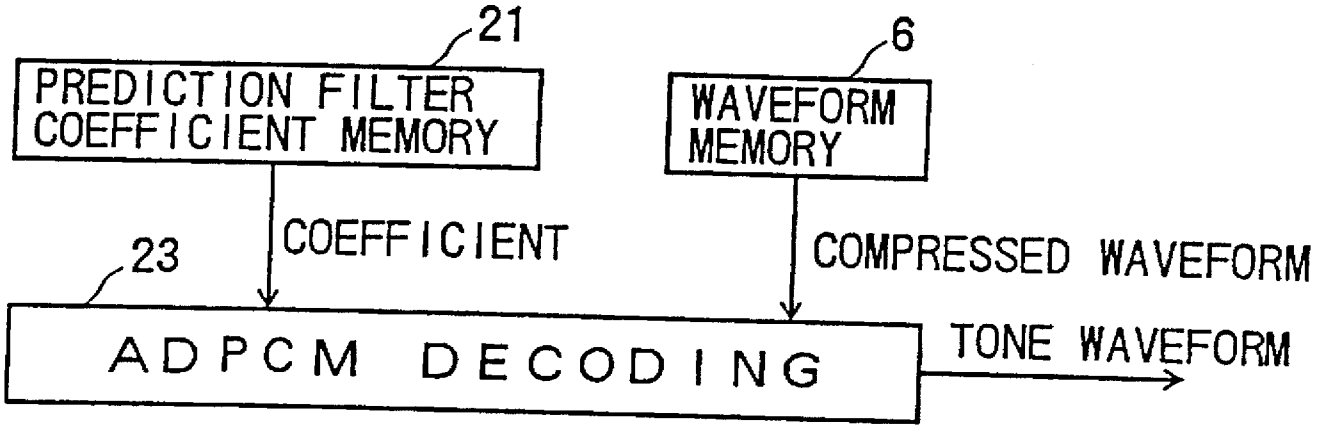
FIG. 7 is a diagram for explaining the structure of a decoder of an electronic instrument that mounts waveform data obtained by the ADPCM method.

Further, when a waveform according to the present invention is included in an electronic musical instrument, a difference is merely that an ADPCM coding unit 23 takes the place of the DPCM coding unit 22, as is shown in FIG. 7 as an example. The ADPCM method is a known technique and the operation procedures are the same as those by the DPCM method.

As is described above, according to the present invention, a waveform that is compressed and coded by the ADPCM method can also be decoded by using the optimal prediction filter coefficient, which is employed to generate the waveform. Therefore, a musical tone having a higher quality can be obtained than that which is obtained by the DPCM coding.

The second invention will now be described. According to this invention, in an electronic musical instrument that uses a general-purpose computer in order to decode a waveform that is compressed by the DPCM method or the ADPCM method and to repeatedly read the waveform, a prediction filter coefficient is so set that the result of the decoding of the repeatedly read waveform matches at the repeatedly read head portion.

Figure 8A:
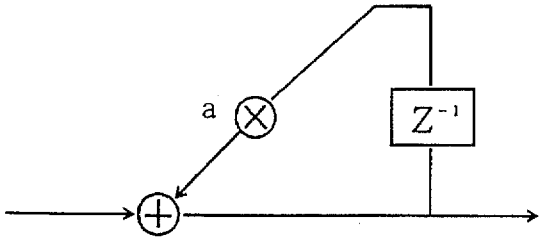
FIGS. 8(*a–d*) is a diagram for explaining the relationship between a filter coefficient and an impulse response.
Figure 8B:
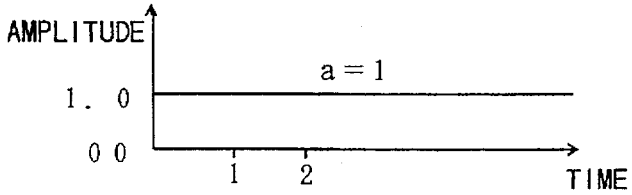
Figure 8C:
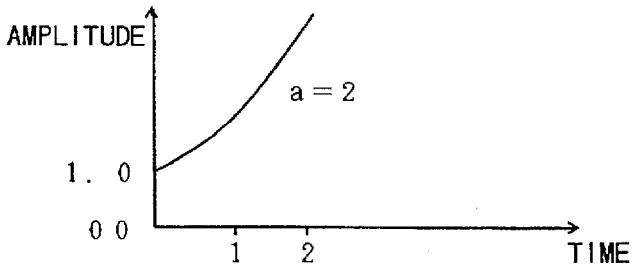
Figure 8D:
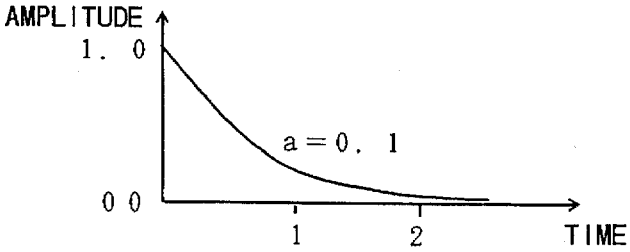

FIGS. 8A through 8D are diagrams for explaining the relationship between a prediction filter coefficient value and stability. In FIG. 8A is shown a primary prediction filter example, and in FIGS. 8B and 8C are shown example impulse responses by an unstable filter. In FIG. 8D is shown am impulse response by a very stable filter.

Suppose that impulse data 1, 0 and 0 are input, and that the filter coefficient of a prediction filter in FIG. 8A is a=1.

In this case, first, "1" is input and "1" is output, and the second time and the following time, "0" is input. A value of "a" times the previously output value is added to "0" by the filter. Thus, as is shown in FIG. 8B, "1" is constantly output by the filter.

With a=2, for example, the output value is 1, 2 or 4, and as is shown in FIG. 8C, an impulse response is rapidly dispersed and causes a failure, such as overflow.

In order for impulse responses to converge within a loop cycle of a waveform that is repeatedly read, when a filter coefficient of a=0.1 is used, for example, the output values are 1, 0.1, 0.01, and 0.001, and quickly becomes close to input value 0.

Errors that are generated due to the repeatedly reading of a waveform are not accumulated at the loop end, and a correct value at the loop top is set when the reading of the next waveform is begun.

Figure 9A:
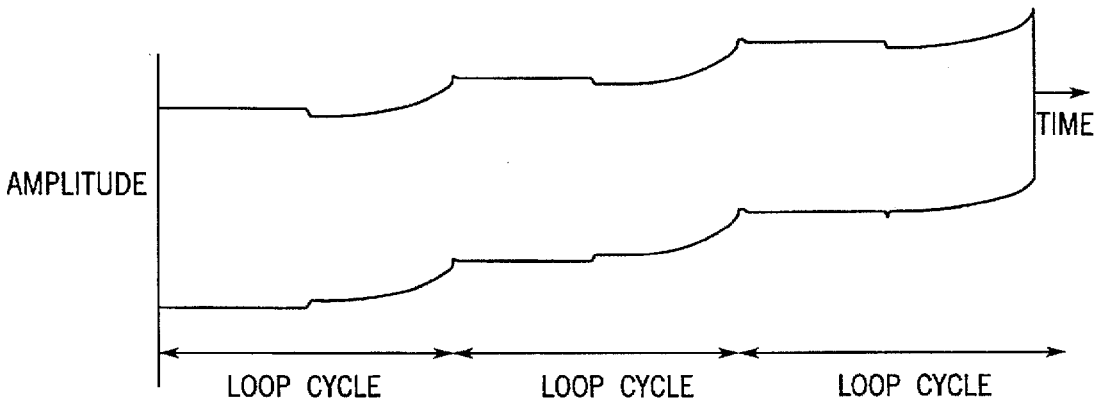
FIGS. 9(*a–b*) is a diagram (continued) for explaining the relationship between a filter coefficient and an impulse response.

FIG. 9A is a diagram showing example errors that are accumulated when the same waveform is repeatedly read. If errors are accumulated as shown in FIG. 9, the amplitude of a waveform with the error added thereto is read at the loop end, and this affects the amplitude, at the loop top, of a waveform that is to be read next time.

Therefore, each time reading is performed, errors are accumulated by the waveform and the amplitude is shifted upward, as is shown in FIG. 9A. If the reading is repeated a number of times, a failure, such as an overflow, will be caused.

Figure 9B:
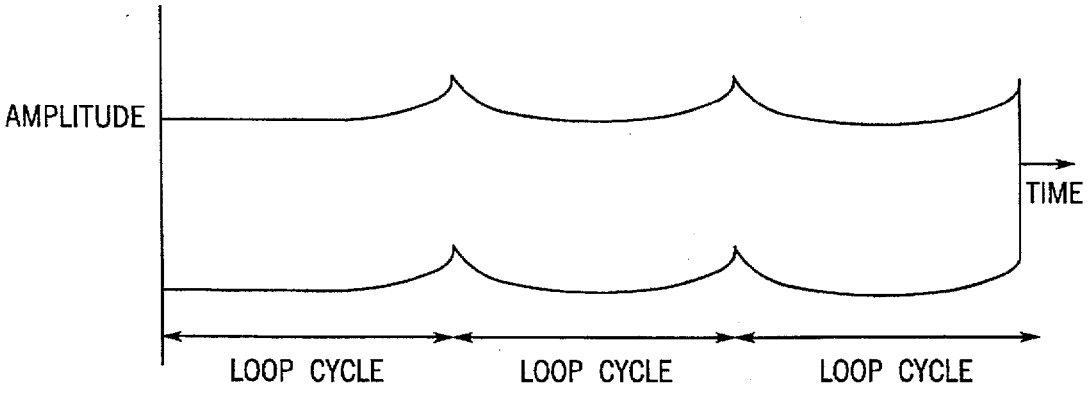

FIG. 9B is a diagram showing an example output when a very stable filter is employed. As is shown, since an error at the loop end is absorbed before the loop is performed for the next reading, an error will not be accumulated each time reading is performed.

Therefore, the stable, repeated reading of the same waveform is possible, as is shown in FIG. 9B, and a device for setting a new value at the loop top is not required.

The present invention is provided to accomplish these objects. A highly stable filter, for which the impulse response converges very quickly, is employed to repeatedly read a waveform that is compressed by the DPCM method, so that the accumulation of errors within a loop interval is prevented.

One embodiment wherein the second invention is applied to the DPCM method or the ADPCM method will now be explained.

In the above description given while referring to FIG. 8, since the primary prediction filter has been employed, convergence is possible as long as the prediction filter coefficient is $-1<a<1$.

However, the shape of the waveform that is actually input varies, and a higher filter, such as a secondary or a tertiary filter, must be employed to increase the filter accuracy and to reduce noise. Because of this, the determination of a prediction filter coefficient is not easy.

According to the second invention, therefore, a general-purpose computer, for example, is used to simulate, in advance, a waveform that is compressed by the DPCM method or the ADPCM method and an optimal prediction filter coefficient that corresponds to the waveform, and the waveform data and prediction filter coefficient that is to be used are obtained. The waveform data and the prediction filter coefficient are then installed in an electronic musical instrument.

The procedures that involve the use of a general-purpose computer for preparing compressed waveform data, for repetitive reading, and a prediction filter coefficient, which are employed in the invention, and the procedures for reproducing the compressed waveform data in an electronic musical instrument are the same as those described in detail for the first invention. Thus, no explanation for them will be given.

In the first invention, a waveform that provides the most preferable frequency weighting is obtained by simulation. And the waveform data, a prediction filter coefficient that is used to generate the waveform, and data for correlating them are acquired and serve as tone data for the electronic musical instrument.

According to the second invention, a difference that exists between it and the first invention is that, to obtain the repeated waveform by simulation, a waveform and a prediction filter coefficient are calculated, so that an error can be absorbed before the repeated waveform reaches the loop end from the loop top, and the acquired waveform and prediction filter coefficient are used as data for the repeated waveform for an electronic musical instrument.

When the present invention is applied to the ADPCM method, the structure and the processing of an apparatus are the same as when the invention is applied to the DPCM method. The only difference is in the coding and the decoding of signals, as previously described.

As is described above, when a filter coefficient, of the present invention, with rapid convergence and high stability is employed, even for a waveform that is compressed by the DPCM or the ADPCM method and coded, the contents of the delay registers 202 and 203 constantly match at the loop top. As a result, a device for resetting the contents at the loop top is not required, and the production of a musical tone having a high quality is possible.

Although the secondary encoder and decoder are employed in the present invention, the present invention is not limited to them. Further, although the prediction filter coefficient memory 52 is provided in the ROM 11, the memory 52 may be otherwise located.

In addition, in this embodiment, a prediction filter coefficient has been obtained for each waveform. So long as an error is absorbed during the period for a waveform that is repeatedly read, the prediction filter coefficient may be changed for each waveform group.

The modes for carrying out the present invention are made up as claims by specially pointing out the subject of the present invention; however, the present invention is not limited to the claims and may be variously modified.

As is described above in detail, according to the first invention, it is possible to provide an electronic musical instrument, wherein a waveform that is compressed by the DPCM coding method or the ADPCM coding method is installed, with which high quality musical tones can be obtained and for which only a small memory capacity is required.

According to the second invention, it is possible to provide an inexpensive electronic musical instrument that does not require resetting when a waveform to be repeatedly read is shifted from the loop end to the loop top, and that has a high compression rate and a simple structure.

Various modes of carrying out the invention are contemplated as being within the scope of the following claims that particularly point out and distinctly claim the subject matter regarded as the invention.

What is claimed is:

1. An electronic musical instrument, which stores and reproduces waveforms that are compressed by a DPCM method or an ADPCM method, comprising means for storing a generated waveform together with a single prediction filter coefficient that is set when an original waveform of said generated waveform was generated and, means employing said predetermined prediction filter coefficient for each waveform to produce a waveform for reproduction.

2. An electronic musical instrument according to claim 1, including prediction filter coefficient calculation means, for sampling said original waveform and for calculating said prediction filter coefficient in advance of storage; prediction filter coefficient storing means, for storing said prediction filter coefficient that is acquired by said prediction filter coefficient calculation means; coding means, for coding said generated waveform in consonance with said prediction filter coefficient, which is acquired by said prediction filter coefficient calculation means, and for compressing said coded waveform; and waveform storage means, for storing said waveform that was coded by said coding means.

3. An electronic musical instrument, which stores generated waveforms that are compressed by a DPCM method or an ADPCM method and decodes compressed data for repeated reading, comprising a prediction filter for coding a waveform that is to be repeatedly read, said prediction filter having a single prediction filter coefficient which is set so that the result of decoding at a repeated reading head portion matches each time, said prediction filter coefficient being employed for each stored waveform to produce a waveform for reproduction.

4. An electronic musical instrument according to claim 3, including prediction filter coefficient calculation means, for sampling an original waveform and calculating said prediction filter coefficient; prediction filter coefficient storing means, for storing said prediction filter coefficient that is acquired by said prediction filter coefficient calculation means; coding means, for coding said generated waveform in consonance with said prediction filter coefficient which is acquired by said prediction filter coefficient which is acquired by said prediction filter coefficient calculation means, and for compressing said coded waveform; and waveform storage means, for storing said waveform that was coded by said coding means.

5. An electronic musical instrument according to claim 3, further comprising: waveform memory, in which waveform data that are acquired by a compression method cited in claim 3 are stored; and prediction coefficient memory, in which said prediction filter coefficient is stored, wherein said waveform that is compressed by said DPCM method or said ADPCM method in consonance with said prediction filter coefficient is repeatedly read and said waveform data are decoded.

6. An electronic musical instrument according to claim 4, further comprising: waveform memory, in which waveform data that are acquired by a compression method cited in claim 4 are stored; and prediction coefficient memory, in which said prediction filter coefficient is stored, wherein said waveform that is compressed by said DPCM method or said ADPCM method in consonance with said prediction filter coefficient is repeatedly read and said waveform data are decoded.

* * * * *